US010837073B2

(12) United States Patent
Sasaki et al.

(10) Patent No.: US 10,837,073 B2
(45) Date of Patent: Nov. 17, 2020

(54) HIGH-STRENGTH HEAVY-WALLED STAINLESS STEEL SEAMLESS TUBE OR PIPE AND METHOD OF MANUFACTURING THE SAME

(71) Applicant: JFE Steel Corporation, Tokyo (JP)

(72) Inventors: Shunsuke Sasaki, Handa (JP); Tatsuro Katsumura, Handa (JP); Yasushi Kato, Handa (JP)

(73) Assignee: JFE Steel Corporation, Tokyo (JP)

( * ) Notice: Subject to any disclaimer, the term of this patent is extended or adjusted under 35 U.S.C. 154(b) by 232 days.

(21) Appl. No.: 15/549,514

(22) PCT Filed: Feb. 20, 2015

(86) PCT No.: PCT/JP2015/000829

§ 371 (c)(1),
(2) Date: Aug. 8, 2017

(87) PCT Pub. No.: WO2016/132403

PCT Pub. Date: Aug. 25, 2016

(65) Prior Publication Data

US 2018/0023158 A1 Jan. 25, 2018

(51) Int. Cl.

| | |
|---|---|
| ***C21D 9/08*** | (2006.01) |
| ***C21D 6/00*** | (2006.01) |
| ***C21D 8/10*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |
| ***C21D 7/12*** | (2006.01) |
| ***B21B 3/02*** | (2006.01) |

(Continued)

(52) U.S. Cl.

CPC ..... *C21D 9/08* (2013.01); *B21B 3/02* (2013.01); *B21B 19/04* (2013.01); *C21D 1/25* (2013.01); *C21D 6/004* (2013.01); *C21D 6/005* (2013.01); *C21D 6/007* (2013.01); *C21D 7/12* (2013.01); *C21D 8/10* (2013.01); *C21D 8/105* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 1/18* (2013.01); *C21D 2211/001* (2013.01); *C21D 2211/005* (2013.01); *C21D 2211/008* (2013.01)

(58) Field of Classification Search

CPC . C21D 9/08; C21D 1/25; C21D 8/105; C21D 7/12; C21D 6/007; C21D 6/005; C21D 6/004; C21D 8/10; C21D 2211/008; C21D 2211/001; C21D 1/18; C21D 2211/005; B21B 19/04; B21B 3/02; C22C 38/54; C22C 38/50; C22C 38/48; C22C 38/46; C22C 38/44; C22C 38/42; C22C 38/06; C22C 38/04; C22C 38/02; C22C 38/005; C22C 38/002; C22C 38/001; C22C 38/58; C22C 38/00

See application file for complete search history.

(56) References Cited

U.S. PATENT DOCUMENTS

2006/0243354 A1* 11/2006 Kimura ..... C21D 1/25 148/592
2010/0058824 A1* 3/2010 Iwamoto ..... B21B 38/04 72/31.07

(Continued)

FOREIGN PATENT DOCUMENTS

CN 1875121 A 12/2006
EP 1 584 699 A1 10/2005

(Continued)

OTHER PUBLICATIONS

Tetsuya et al., JP 3127822B2. machine translation (Year: 2001).*

(Continued)

*Primary Examiner* — John A Hevey
(74) *Attorney, Agent, or Firm* — DLA Piper LLP (US)

(57) ABSTRACT

A high-strength heavy-walled stainless steel seamless tube or pipe exhibiting excellent low-temperature toughness is characterized by having a chemical composition containing Cr: 15.5% to 18.0% and a steel microstructure containing a ferritic phase and a martensitic phase, wherein the maximum value of the areas of the ferrite grains in the steel microstructures in a circumferential direction cross section and an L direction (rolling direction) cross section of the steel tube or pipe is 3,000 $\mu m^2$ or less and the content of ferrite grains having areas of 800 $\mu m^2$ or less is 50% or more on an area fraction basis, where, when adjacent ferrite grains are present in the steel microstructure and the crystal misorientation between one ferrite grain and the other ferrite grain is 15° or more, the adjacent grains are assumed to be grains different from each other.

4 Claims, No Drawings

(51) Int. Cl.

| | |
|---|---|
| ***B32B 19/04*** | (2006.01) |
| ***C21D 1/25*** | (2006.01) |
| ***B21B 19/04*** | (2006.01) |
| *C21D 1/18* | (2006.01) |

(56) References Cited

U.S. PATENT DOCUMENTS

| | | | | |
|---|---|---|---|---|
| 2010/0308612 | A1 | 12/2010 | Antunes et al. | |
| 2011/0290377 | A1 | 12/2011 | Suwabe et al. | |
| 2012/0031530 | A1 | 2/2012 | Takabe et al. | |
| 2015/0047831 | A1* | 2/2015 | Nakatsuka | C21D 9/08 166/242.1 |
| 2015/0101711 | A1* | 4/2015 | Miyata | C22C 38/44 148/506 |
| 2016/0215359 | A1 | 7/2016 | Eguchi et al. | |

FOREIGN PATENT DOCUMENTS

| | | | | |
|---|---|---|---|---|
| EP | 2 918 697 | | 9/2015 | |
| JP | 3-180427 | A | 8/1991 | |
| JP | 6-100931 | A | 4/1994 | |
| JP | 7-207337 | A | 8/1995 | |
| JP | 9-271811 | A | 10/1997 | |
| JP | 3127822 | B2 * | 1/2001 | |
| JP | 2005-336595 | A | 12/2005 | |
| JP | 2008-081793 | | 4/2008 | |
| RU | 2 307 876 | C2 | 10/2007 | |
| RU | 2 338 797 | C2 | 11/2008 | |
| RU | 2 487 951 | C2 | 7/2013 | |
| WO | 2010/082395 | A1 | 7/2010 | |
| WO | 2010/134498 | A1 | 11/2010 | |
| WO | 2013/146046 | A1 | 10/2013 | |
| WO | 2013/179667 | A1 | 12/2013 | |
| WO | WO-2013179667 | A1 * | 12/2013 | C21D 9/08 |
| WO | 2014/097628 | | 6/2014 | |
| WO | 2015/033518 | A1 | 3/2015 | |

OTHER PUBLICATIONS

Canadian Office Action dated Jul. 4, 2018, of counterpart Canadian Application No. 2,971,828.

Chinese Office Action dated Dec. 17, 2018, of counterpart Chinese Application No. 201580076443.1, along with a Search Report in English.

Korean Office Action dated Oct. 25, 2018, of counterpart Korean Application No. 10-2017-7022290, along with a Concise Statement of Relevance in English.

Supplementary European Search Report dated Nov. 7, 2017, of corresponding European Application No. 15882509.1.

Russian Office Action dated Oct. 18, 2018, of counterpart Russian Application No. 2017129351, along with an English translation.

Chinese Office Action dated May 2, 2018, of corresponding Chinese Application No. 201580076443.1, along with the Search Report in English.

Korean Office Action dated May 15, 2019, of counterpart Korean Applicaion No. 10-2017-7022290, along with an English translation including a Concise Statement of Relevance of Office Action.

Canadian Office Action dated Jul. 12, 2019, 2019 of counterpart Canadian Application No. 2,971,828.

European Office Action dated Jun. 19, 2020, of counterpart European Application No. 15882509.1.

* cited by examiner

HIGH-STRENGTH HEAVY-WALLED STAINLESS STEEL SEAMLESS TUBE OR PIPE AND METHOD OF MANUFACTURING THE SAME

TECHNICAL FIELD

This disclosure relates to a high-strength heavy-walled stainless steel seamless tube or pipe having high strength and excellent low-temperature toughness, and a method of manufacturing the same.

BACKGROUND

In recent years, from the viewpoint of high energy prices of crude oil and the like and exhaustion of petroleum due to an increase in global energy consumption volume, energy resource developments have been actively conducted in oil fields at great depths (deep oil fields) that had not been searched, in oil fields and gas fields in a severe corrosion environment, in a so-called "sour" environment, containing hydrogen sulfide and the like and, furthermore, in oil fields, gas fields and the like at far north locations and in severe meteorological environments. A steel tube or pipe used in such environments is required to have high strength, excellent corrosion resistance (sour resistance) and, furthermore, excellent low-temperature toughness in combination. In addition, the wall thickness of the steel tube or pipe is changed from a small wall thickness to a large wall thickness in accordance with specific uses.

In oil fields and gas fields in environments containing carbon dioxide gas $CO_2$, chlorine ions $Cl^-$ and the like, in many cases, a 13% Cr martensitic stainless steel tube or pipe has been employed for development drilling.

However, the 13% Cr martensitic stainless steel tube or pipe does not have sufficient corrosion resistance in a sour environment. Therefore, the use of duplex phase stainless steel tube or pipe, in which the carbon content is reduced and the amount of Cr and the amount of Ni are increased, has recently spread.

For example, Japanese Unexamined Patent Application Publication No. 2005-336595 describes a method of manufacturing a high-strength stainless steel tube or pipe for Oil Country Tubular Goods having excellent corrosion resistance. According to the method described in Japanese Unexamined Patent Application Publication No. 2005-336595, the high-strength stainless steel tube or pipe for Oil Country Tubular Goods having a microstructure containing, on a volume fraction basis, 10% to 60% of ferritic phase and the remainder composed of martensitic phase and a yield strength of 654 MPa or more can be obtained by heating a steel having a chemical composition containing, on a percent by mass basis, C: 0.005% to 0.050%, Si: 0.05% to 0.50%, Mn: 0.20% to 1.80%, Cr: 15.5% to 18%, Ni: 1.5% to 5%, Mo: 1% to 3.5%, V: 0.02% to 0.20%, N: 0.01% to 0.15%, and O: 0.006% or less, where $Cr+0.65Ni+0.6Mo+0.55Cu-20C \geq 19.5$ and $Cr+Mo+0.3Si-43.5C-0.4Mn-Ni-0.3Cu-9N \geq 11.5$ (the symbol of elements in the formulae refers to the content (percent by mass) of the respective elements) are satisfied, performing pipe-making through hot working, performing cooling after the pipe-making to room temperature at a cooling rate larger than or equal to that of air cooling to produce a seamless steel tube or pipe with predetermined dimensions, reheating the resulting seamless steel tube or pipe to a temperature of 850° C. or higher, performing cooling to 100° C. or lower at a cooling rate larger than or equal to that of air cooling, and performing a quench-tempering treatment at a temperature of 700° C. or lower. According to Japanese Unexamined Patent Application Publication No. 2005-336595, the resulting steel tube or pipe has high strength, sufficient corrosion resistance even at severe corrosive environment containing $CO_2$ and $Cl^-$ at a high temperature up to 230° C., and excellent toughness with absorbed energy of 50 J or more at −40° C.

An austenite-ferritic stainless steel (hereafter may be referred to as a duplex phase stainless steel) such as 22% Cr steel and 25% Cr steel have been previously known. That duplex phase stainless steel has been used to manufacture a stainless steel tube or pipe for Oil Country Tubular Goods or the like used in severe corrosive environments containing, in particular, a large amount of hydrogen sulfide at a high temperature. As for the above-described duplex phase stainless steel, various types of high, about 21% to 28%, Cr based ultra low carbon steel containing Mo, Ni, N and the like have been developed, and SUS329J1, SUS329J3L, SUS329J4L and the like are specified in JIS G 4303 to 4305 of Japanese Industrial Standards.

Large amounts of alloy elements are added to those steels and, therefore, a ferritic phase is present in a range of high temperature to room temperature without phase transformation. Meanwhile, particularly in a heavy-walled stainless steel tube or pipe, that ferritic phase does not easily effectively accumulate strain during hot working and a ferritic phase having coarse grains is held at room temperature. The coarse ferritic phase degrades the low-temperature toughness, as a matter of course, and impairs the effect of improving the yield strength brought about by fine grains of the ferritic phase so that not only the toughness, but also the strength is decreased at the same time.

A high-strength stainless steel tube or pipe to solve such problems is proposed in, for example, Domestic Re-publication of PCT International Publication for Patent Application No. WO2010/82395. The method described in Domestic Re-publication of PCT International Publication for Patent Application No. WO2010/82395 is characterized by producing an element tube or pipe for cold working through hot working or hot working and solution heat treatment of a duplex phase stainless steel having a chemical composition containing, on a percent by mass basis, C: 0.03% or less, Si: 1% or less, Mn: 0.1% to 4%, Cr: 20% to 35%, Ni: 3% to 10%, Mo: 0% to 6%, W: 0% to 6%, Cu: 0% to 3%, N: 0.15% to 0.60%, and the remainder composed of Fe and incidental impurities and, thereafter, performing cold rolling under the condition in which the processing rate Rd in a final cold rolling step is 10% to 80%, in terms of reduction in area, and satisfies formula (1).

$$Rd=\exp[\{\ln(MYS)-\ln(14.5\times Cr+48.3\times Mo+20.7\times W+6.9\times N)\}/0.195] \quad (1)$$

In formula (1), Rd: reduction in area (%), MYS: aimed yield strength (MPa), and Cr, Mo, W, and N: content of element (percent by mass) hold good.

According to Domestic Re-publication of PCT International Publication for Patent Application No. WO2010/82395, a high-strength duplex phase stainless steel seamless tube or pipe is obtained by strictly controlling the proper chemical composition and the cold processing rate.

Also, for example, Japanese Unexamined Patent Application Publication No. Hei07-207337 proposes a method of manufacturing a high-strength duplex phase stainless steel, wherein after solution treatment of an austenite-ferritic duplex phase stainless steel containing Cu, cold rolling is performed at a reduction in area of 35% or more, followed by heating to a temperature range of 800° C. to 1,150° C. at a heating rate of 50° C./s or more, quenching, warm working at 300° C. to 700° C., and cold working again or further performing an aging treatment at 450° C. to 700° C. In the method described in Japanese Unexamined Patent Application Publication No. Hei07-207337, the working and the heat treatment are combined to make the steel microstructure fine so that even when cold working is performed, the amount of processing thereof can be reduced considerably. Consequently, according to the high-strength duplex phase stainless steel described in Japanese Unexamined Patent Application Publication No. Hei07-207337, degradation of corrosion resistance can be prevented.

Recently, a heavy-walled steel has been frequently used as a base steel for a steel tube or pipe for Oil Country Tubular Goods with great depths. In production of the heavy-walled steel, as the wall thickness increases, it becomes difficult to give predetermined processing strain to the center of the wall thickness by the common hot working method. Consequently, the microstructure of the wall thickness central portion in the heavy-walled steel tends to be coarsened. Therefore, the toughness of the wall thickness central portion in a heavy-walled steel is degraded easily compared to that of a light-walled steel.

Japanese Unexamined Patent Application Publication No. 2005-336595 and Domestic Re-publication of PCT International Publication for Patent Application No. WO2010/82395 refer only to steels having a wall thicknesses of 12.7 mm at the most and, therefore, heavy-walled steels having a wall thickness of 12.7 mm or more are not studied. In particular, in Japanese Unexamined Patent Application Publication No. 2005-336595 and Domestic Re-publication of PCT International Publication for Patent Application No. WO2010/82395, improvement of characteristics of the heavy-walled steel, in particular, improvement of the low-temperature toughness is not studied.

Meanwhile, in Domestic Re-publication of PCT International Publication for Patent Application No. WO2010/82395, the processing rate in terms of reduction in area has to be specified to be large and, therefore, a large amount of plant and equipment investment in a powerful cold working apparatus to work a high-strength duplex phase stainless steel having high deformation resistance is required.

Also, in the method described in Japanese Unexamined Patent Application Publication No. Hei07-207337, degradation of corrosion resistance at, in particular, high temperature and wet environment due to an increase in the processing rate of the cold working is pointed out and it is mentioned that enhancement in strength by making the microstructure fine and optimizing the shape and the amount of precipitates and reduction in processing rate of the cold working are effective in improvement of corrosion resistance. The method described in Japanese Unexamined Patent Application Publication No. Hei07-207337 requires a plurality of heat treatments including a solution heat treatment and a heat treatment after the cold working, therefore the manufacturing step becomes complicated, and the productivity is reduced. In addition, usage of energy increases, resulting in an increase in production cost. Also, there is a problem that flaws by working are generated in warm working at 300° C. to 700° C.

Grain growth of ferrite grains during holding at high temperatures is fast and grain coarsening occurs easily because of growth of crystal grains at an initial stage and crystal grains would be divided by hot working. In particular, the wall thickness central portion of the heavy-walled steel is not given with strain easily. Therefore, ferrite grains cannot be divided and coarsening of ferrite grains occur during a short time holding at high temperatures and cooling after hot rolling. Connected coarse ferrite grains serve as a propagation path of cracks and, thereby, the toughness of a steel slab rolled at high temperatures and the wall thickness central portion (low-strain portion) of the heavy-walled steel, where the proportion of ferritic phase is large, is degraded. Coarsening of ferrite grains has an influence on the strength as well and, in particular, the yield strength is reduced. Consequently, predetermined characteristics are not obtained unless the hot rolling condition and the temperature control in the heat treatment thereafter are controlled.

It could therefore be helpful to provide a high-strength heavy-walled stainless steel seamless tube or pipe with a wall thickness central portion having excellent yield strength and low-temperature toughness and a method of manufacturing the same.

SUMMARY

We thus provide:

[1] A high-strength heavy-walled stainless steel seamless tube or pipe with excellent low-temperature toughness, characterized by having a chemical composition containing, on a percent by mass basis, Cr: 15.5% to 18.0% and a steel microstructure containing a ferritic phase and a martensitic phase, wherein the maximum value of the areas of the ferrite grains in the steel microstructures in a circumferential direction cross section and an L direction (rolling direction) cross section of the steel tube or pipe is 3,000 $\mu m^2$ or less and the content of ferrite grains having areas of 800 $\mu m^2$ or less is 50% or more on an area fraction basis, where when adjacent ferrite grains are present in the above-described steel microstructure and the crystal misorientation between one ferrite grain and the other ferrite grain is 15° or more, the above-described adjacent grains are assumed to be grains different from each other.

[2] The high-strength heavy-walled stainless steel seamless tube or pipe according to [1], characterized in that the chemical composition further contains, on a percent by mass basis, C: 0.050% or less, Si: 1.00% or less, Mn: 0.20% to 1.80%, Ni: 1.5% to 5.0%, Mo: 1.0% to 3.5%, V: 0.02% to 0.20%, N: 0.01% to 0.15%, O: 0.006% or less, and the remainder composed of Fe and incidental impurities.

[3] The high-strength heavy-walled stainless steel seamless tube or pipe according to [2], characterized in that the chemical composition further contains at least one group selected from Group A to Group D below.

Group A: Al: 0.002% to 0.050%

Group B: at least one selected from Cu: 3.5% or less, W: 3.5% or less, and REM: 0.3% or less Group C: at least one selected from Nb: 0.2% or less, Ti: 0.3% or less, and Zr: 0.2% or less Group D: at least one selected from Ca: 0.01% or less and B: 0.01% or less

[4] The high-strength heavy-walled stainless steel seamless tube or pipe according to any one of [1] to [3], characterized in that the maximum value of the areas of the ferrite grains in the steel microstructures in a circumferential direction cross section and an L direction (rolling direction) cross section of the steel tube or pipe is 3,000 $\mu m^2$ or less and the content of ferrite grains having areas of 800 $\mu m^2$ or less is 50% or more on an area fraction basis.

[5] A method of manufacturing a high-strength heavy-walled stainless steel seamless tube or pipe, characterized by including the steps of heating a steel, performing piercing the steel to produce a hollow base steel, and subjecting the hollow base steel to elongating rolling, wherein the hot working temperature of the above-described elongating rolling is 700° C. to 1,200° C., and the steel microstructure of the above-described hollow base steel at the above-described hot working temperature contains 35% or more of austenite on an area fraction basis.

The high-strength heavy-walled stainless steel seamless tube or pipe with excellent low-temperature toughness can be produced easily and, therefore, an industrially considerable effect is exerted. Also, ferrite grains of the ferritic phase in the steel microstructure of the high-strength heavy-walled stainless steel seamless tube or pipe can be made fine up to the wall thickness central portion and, therefore, there is an effect that the low-temperature toughness and the yield strength of even a heavy-walled stainless steel tube or pipe, which is not easily made fine through accumulation of strain, are improved.

DETAILED DESCRIPTION

We examined various factors affecting the toughness of the wall thickness central portion of a heavy-walled stainless steel tube or pipe serving as a high-strength heavy-walled stainless steel seamless tube or pipe. We found that as for ferrite grains dispersed in the steel microstructure, even when grains were equally ferrite grains, the grains were assumed to be different from each other when the crystal misorientation was 15° or more, and the ferrite grains were made fine.

Then, we examined the morphology for making ferrite grains of a heavy-walled stainless steel tube or pipe fine and found that the low-temperature toughness and the yield strength were able to be considerably improved by adjusting the maximum area of the ferrite grains and the content of ferrite grains having a predetermined area or less, where the grains were assumed to be different from each other when the crystal misorientation was 15° or more. In this regard, the crystal orientations of ferrite grains can be discriminated on the basis of EBSD (electron backscatter diffraction) or the like.

Also, most of the steel microstructure of a steel containing Cr: 15.5% to 18.0% becomes ferritic phase by being heated to 1,100° C. to 1,350° C. The above-described ferritic phase is transformed to an austenitic phase in the process in which the steel heated to 1,100° C. to 1,350° C. is cooled to 700° C. to 1,200° C. that is a hot working temperature. The ferrite grains are made fine and the the low-temperature toughness and the yield strength are improved by understanding this transformation behavior, performing rolling under the condition to obtain a predetermined phase fraction, and performing a heat treatment thereafter.

Also, the improvement of the low-temperature toughness and the strength can be realized by lowering the working temperature to bring about a state in which 35% or more of austenitic phase is present during hot working and, thereby, concentrating strain on the ferritic phase having relatively low strength during hot working to make the ferrite grains fine.

Examples of our steel pipes, tubes and methods will be described below. In this regard, this disclosure is not limited to the following examples. Also, in the following description, the term "%" representing the content of each element refers to "percent by mass" unless otherwise specified.

The chemical composition of the high-strength heavy-walled stainless steel seamless tube or pipe (hereafter may be simply referred to as "steel tube or pipe") only needs to be a chemical composition containing Cr: 15.5% to 18.0%.

Cr: 15.5% to 18.0%

Chromium is an element having a function of forming a protective film to improve the corrosion resistance and, in addition, forms a solid solution to enhance the strength of steel. It is necessary that the Cr content be 15.5% or more to obtain such effects. On the other hand, if the Cr content is more than 18.0%, the strength is reduced. Consequently, the Cr content is limited to 15.5% to 18.0%. 15.5% to 18.0% is preferable.

This disclosure is directed to Cr-containing steels previously used as a base steel for heavy-walled stainless steel seamless tube or pipe for Oil Country Tubular Goods and is characterized in that the state of ferrite grains in the steel microstructure of the Cr-containing steel is adjusted. Therefore, in the chemical composition, only Cr is specified and other elements are not particularly specified.

As described above, other elements are not specifically limited, although the chemical composition of the heavy-walled stainless steel seamless tube or pipe is preferably a chemical composition further containing, on a percent by mass basis, C: 0.050% or less, Si: 1.00% or less, Mn: 0.20% to 1.80%, Ni: 1.5% to 5.0%, Mo: 1.0% to 3.5%, V: 0.02% to 0.20%, N: 0.01% to 0.15%, O: 0.006% or less, and the remainder composed of Fe and incidental impurities.

C: 0.050% or Less

Carbon is an important element related to the strength of martensitic stainless steel. It is desirable that the C content be specified to be 0.005% or more to ensure predetermined strength. On the other hand, if the C content is more than 0.050%, sensitization due to contained Ni during tempering may increase. Meanwhile, it is desirable that the C content be small from the viewpoint of the corrosion resistance. Consequently, the C content is preferably 0.050% or less. 0.030% to 0.050% is more preferable.

Si: 1.00% or Less

Silicon is an element that functions as a deoxidizing agent. It is desirable that the Si content be 0.05% or more to obtain an effect of the deoxidizing agent. On the other hand, if the Si content is more than 1.00%, the corrosion resistance is degraded and, furthermore, hot workability may be degraded. Consequently, the Si content is preferably 1.00% or less, and more preferably 0.10% to 0.30%.

Mn: 0.20% to 1.80%

Manganese is an element having a function of enhancing the strength. It is desirable that the Mn content be specified to be 0.20% or more to obtain this effect. On the other hand, if the Mn content is more than 1.80%, the toughness may be adversely affected. Consequently, the Mn content is preferably 0.20% to 1.80%, and more preferably 0.20% to 1.00%.

Ni: 1.5% to 5.0%

Nickel is an element having a function of strengthening a protective film to enhance corrosion resistance. Also, Ni is an element that forms a solid solution to enhance the strength of steel and, in addition, improve toughness. It is preferable that the Ni content be 1.5% or more to obtain such effects. On the other hand, if the Ni content is more than 5.0%, the stability of martensitic phase is degraded and strength may be reduced. Consequently, the Ni content is preferably 1.5% to 5.0%, and more preferably 2.5% to 4.5%.

Mo: 1.0% to 3.5%

Molybdenum is an element that enhances the pitting corrosion resistance due to $Cl^-$. It is desirable that the Mo content is 1.0% or more to obtain such an effect. On the other hand, if the Mo content is more than 3.5%, the steel cost may increase. Consequently, the Mo content is preferably 3.5% or less, and more preferably 2.0% to 3.5%.

V: 0.02% to 0.20%

Vanadium is an element that enhances the strength and, in addition, improves the corrosion resistance. It is preferable that the V content be specified to be 0.02% or more to obtain these effects. On the other hand, if the V content is more than 0.20%, toughness may be degraded. Consequently, the V content is preferably 0.02% to 0.20%, and more preferably 0.02% to 0.08%.

N: 0.01% to 0.15%

Nitrogen is an element that considerably improves pitting corrosion resistance. It is preferable that the N content be 0.01% or more to obtain this effect. On the other hand, if the N content is more than 0.15%, various nitrides are formed and toughness may be degraded. The N content is more preferably 0.02% to 0.08%.

O: 0.006% or Less

Oxygen is present as oxides in the steel and adversely affects various characteristics. Consequently, it is desirable that the 0 content be minimized. In particular, if the 0 content is more than 0.006%, hot workability, toughness, and corrosion resistance may be significantly degraded. Therefore, the 0 content is preferably 0.006% or less.

In addition to the above-described elements, at least one group selected from Group A to Group D below can further be contained:

Group A: Al: 0.002% to 0.050%

Group B: at least one selected from Cu: 3.5% or less, W: 3.5% or less, and REM: 0.3% or less Group C: at least one selected from Nb: 0.2% or less, Ti: 0.3% or less, and Zr: 0.2% or less Group D: at least one selected from Ca: 0.01% or less and B: 0.01% or less The elements of Group A to Group D will be described below.

Group A: Al: 0.002% to 0.050%

Al may be utilized as an element functioning as a deoxidizing agent. In utilization as a deoxidizing agent, the Al content is preferably 0.002% or more. If the Al content is more than 0.050%, toughness may be adversely affected. Consequently, when Al is contained, limitation to Al: 0.050% or less is preferable. When Al is not added, Al: less than 0.002% is allowed as an incidental impurity.

Group B: At Least One Selected from Cu: 3.5% or Less, W: 3.5% or Less, and REM: 0.3% or Less Group B: Cu, W, and REM strengthen a protective film, suppress permeation of hydrogen into steel, and enhance the sulfide stress corrosion cracking resistance. Such effects are considerable when Cu: 0.5% or more, W: 0.5% or more, or REM: 0.001% or more is contained. However, if Cu: more than 3.5%, W: more than 3.5%, or REM: more than 0.3% is contained, the toughness may be degraded. Consequently, when the elements described in Group B are contained, limitation to Cu: 3.5% or less, W: 3.5% or less, and REM: 0.3% or less is preferable. In this regard, Cu: 0.8% to 1.2%, W: 0.8% to 1.2%, and REM: 0.001% to 0.010% are more preferable.

Group C: At Least One Selected from Nb: 0.2% or Less, Ti: 0.3% or Less, and Zr: 0.2% or Less All Nb, Ti, and Zr are elements that enhance strength. The chemical composition of the high-strength heavy-walled stainless steel seamless tube or pipe may contain these elements, as necessary. Such an effect is observed when Nb: 0.03% or more, Ti: 0.03% or more, or Zr: 0.03% or more is contained. On the other hand, if Nb: more than 0.2%, Ti: more than 0.3%, or Zr: more than 0.2% is contained, toughness is degraded. Consequently, limitation to Nb: 0.2% or less, Ti: 0.3% or less, and Zr: 0.2% or less is preferable.

Group D: At Least One Selected from Ca: 0.01% or Less and B: 0.01% or Less

Ca and B have a function of improving hot workability during multiphase region rolling to suppress product flaws, and at least one of them can be contained, as necessary. Such an effect is considerable when Ca: 0.0005% or more or B: 0.0005% or more is contained. If Ca: more than 0.01% or B: 0.01% or more is contained, the corrosion resistance is degraded. Consequently, when they are contained, limitation to Ca: 0.01% or less and B: 0.01% or less is preferable.

The remainder other than the above-described elements is composed of Fe and incidental impurities. In this regard, as for the incidental impurities, P: 0.03% or less and S: 0.005% or less are allowable.

Next, the steel microstructure of the high-strength heavy-walled stainless steel seamless tube or pipe will be described. The steel microstructure of the steel tube or pipe contains a martensitic phase and a ferritic phase. Also, an austenitic phase may be contained.

The content of martensitic phase is preferably 50% or more, on an area fraction basis, to realize high strength. As described below, it is preferable that 20% or more of ferritic phase, on an area fraction basis, be contained besides the martensitic phase. Therefore, to contain 20% or more of ferritic phase, on an area fraction basis, the content of martensitic phase is preferably 80% or less on an area fraction basis.

As described later, the ferritic phase is an important phase to allow the steel tube or pipe to exhibit excellent low-temperature toughness and corrosion resistance. The content thereof is preferably 20% or more on an area fraction basis, and more preferably 25% or more. Also, it is preferable that 50% or more of martensitic phase, on an area fraction basis, be contained to realize high strength and, therefore, the content of ferritic phase is preferably 50% or less.

An austenitic phase may be contained besides the ferritic phase and the martensitic phase. If the content of austenitic phase is excessive, the strength of steel is reduced. Therefore, the content of austenitic phase is preferably 15% or less on an area fraction basis.

Then, the ferritic phase will be further described. The ferritic phase in the steel microstructure of the steel tube or pipe is distributed in the shape of a belt and the shape of a network in the steel microstructure. It is considered that a belt-shaped ferritic phase is formed from ferrite grains where, when adjacent ferrite grains are present in the steel microstructure and the crystal misorientation between one ferrite grain and the other ferrite grain is 15° or more, the above-described adjacent grains are assumed to be grains different from each other. On the basis of this consideration, the steel tube or pipe is allowed to have high strength and exhibit excellent low-temperature toughness and corrosion resistance by satisfying Conditions 1 and 2 described below. In this regard, the ferrite grains may be in the state of any one of being surrounded by ferrite grains exhibiting crystal misorientation of 15° or more, being surrounded by other phases (martensitic phase and austenitic phase), and being surrounded by ferrite grains exhibiting crystal misorientation of 15° or more and other phases.

Condition 1: The maximum value of the areas of the ferrite grains in the steel microstructures in a circumferential direction cross section and an L direction (rolling direction) cross section of the steel tube or pipe is 3,000 $\mu m^2$ or less.

Condition 2: The content of ferrite grains having areas of 800 $\mu m^2$ or less is 50% or more, on an area fraction basis, in a circumferential direction cross section and an L direction (rolling direction) cross section of the steel tube or pipe.

With respect to Condition 1, the fact that the maximum value of the areas of the ferrite grains in the steel microstructures in a circumferential direction cross section and an L direction (rolling direction) cross section of the steel tube or pipe is more than 3,000 $\mu m^2$ refers to that unusually grown ferritic grains are present in the steel microstructure. If the unusually grown ferrite grains are present, the low-temperature toughness is extremely reduced. An occurrence of unevenness in the property of a product, for example, partial reduction in the low-temperature toughness value, is not favorable. Consequently, the maximum value of the areas of the ferrite grains in the steel microstructures in a circumferential direction cross section and an L direction (rolling direction) cross section of the steel tube or pipe is specified to be 3,000 $\mu m^2$ or less, preferably 1,000 $\mu m^2$ or less, and more preferably 200 $\mu m^2$ or less.

With respect to Condition 2, reduction in the low-temperature toughness value and the yield strength can be suppressed by specifying the content of ferrite grains having areas of 800 $\mu m^2$ or less to be 50% or more, on an area fraction basis, in a circumferential direction cross section and an L direction (rolling direction) cross section of the steel tube or pipe. Preferably, the content of ferrite grains having areas of 400 $\mu m^2$ or less is 50% or more, on an area fraction basis, and more preferably, the content of ferrite grains having areas of 100 $\mu m^2$ or less is 80% or more on an area fraction basis.

It is preferable that Conditions 1 and 2 are satisfied in both microstructures in a circumferential direction cross section and an L direction (rolling direction) cross section of the steel tube or pipe. The ferritic phase remains from the stage at a high temperature of furnace-equivalent temperature to the stage of a product and fragmentation due to transformation and recrystallization does not occur easily. Consequently, the grain shape exhibits anisotropy easily on the basis of the direction of strain during hot rolling in the ferritic phase. Anisotropy occurs in the ferritic phase because of a difference in rolling system in production of the heavy-walled stainless steel seamless tube or pipe, and anisotropy occurs in the low-temperature toughness value of the microstructure in which most of ferrite grains have grown in some direction. An occurrence of anisotropy in the characteristics is not favorable because poorer-than-predetermined characteristics may be exhibited depending on the direction of the load applied in the use of the product. When it is ascertained that Conditions 1 and 2 are satisfied in both the circumferential direction cross section and the L direction (rolling direction) cross section of the steel tube or pipe, the anisotropy can be rated as small. In this regard, a method in which ferrite grain is three-dimensionally observed and the anisotropy is evaluated on the basis of the volume of the grain may be employed, but is not performed easily because the measurement requires much expense in time and effort. Therefore, observation of the above-described two cross sections is simple and favorable. Here, the cross section refers to a circumferential direction cross section and an L direction (rolling direction) cross section that can be observed in the wall thickness central portion at the center in the rolling direction of the steel tube or pipe.

The steel microstructure of the steel tube or pipe is measured by the following method. The ferritic phase fraction is determined with an optical microscope and an electron scanning microscope. The austenitic phase fraction can be measured with an X-ray diffractometer. The martensitic phase fraction can be determined by subtracting the ferritic phase fraction and the austenitic phase fraction from 100%. The crystal misorientation in the ferritic phase can be measured on the basis of EBSD. In this regard, when separation of the ferritic phase from the martensitic phase in steel is difficult because of being the same body-centered cubic structure, only the ferritic phase can be extracted by performing SEM-EDX (scanning electron microscope-energy dispersive X-ray spectrometry) or EPMA (electron probe micro analysis) measurement in the same field of view in advance and examining element partition of ferritic phase formation elements and austenitic phase formation elements. Also, a method in which ferrite grains are individually selected on the basis of the results of EBSD may be employed. In the EBSD measurement, after sample preparation is performed by electrochemical polishing, adjustment is performed such that a sufficient number of ferrite grains can be measured in the same field of view at the magnification of 500 times to 2,000 times. A field of view of 100×100 μm or more at the minimum, and if possible 1,000×1,000 μm, is ensured and the microstructure is observed. The distance between measurement points in crystal orientation measurement by EBSD is adjusted such that the distance does not excessively increase and the distance is specified to be 0.5 μm at the minimum, and preferably 0.3 μm or less to reduce errors in analysis of the ferrite grain area after the measurement. The measurement is performed at a high magnification and the field of view is limited. Therefore, it is favorable that at least 10 to 15 fields of view are observed in the vicinity of the wall thickness central portion and the maximum ferrite grain area and the grain area distribution are examined.

The above-described high-strength heavy-walled stainless steel seamless tube or pipe has a yield strength of 654 MPa or more and excellent low-temperature toughness of absorbed energy of 50 J or more at a test temperature of −10° C. in Charpy impact test at the wall thickness center position. Also, the high-strength heavy-walled stainless steel seamless tube or pipe exhibits excellent corrosion resistance on the basis of the above-described chemical composition.

Also, the wall thickness of the high-strength heavy-walled stainless steel seamless tube or pipe is 12.7 mm or more and less than 100 mm.

Next, a method of manufacturing the high-strength heavy-walled stainless steel seamless tube or pipe will be described. The high-strength heavy-walled stainless steel seamless tube or pipe can be manufactured by preparing a steel having the above-described chemical composition, heating the steel, cooling the heated steel to a predetermined working temperature, and hot-working the cooled steel. The manufacturing method will be described below more specifically. In the following description, the temperature refers to a wall thickness center temperature unless otherwise specified. In this regard, the temperature may be measured by embedding a thermocouple into the inside of the steel or may be calculated by heat transfer calculation on the basis of results of the surface temperature measurement with other noncontact thermometer.

The method of preparing the above-described steel is not necessarily specifically limited. Preferably, a molten steel having the above-described chemical composition is produced by using a common smelting furnace, e.g., a converter or an electric furnace, and is cast into a slab (round cast slab) by a common casting process, e.g., a continuous casting process to be used as the steel. In this regard, the cast slab may be hot-rolled into a steel slab having a predetermined dimension to be used as the steel. Also, no problem occurs when a steel slab is prepared by an ingot-making and blooming method to be used as the steel.

The heating temperature of the above-described steel before hot working is not specifically limited. The heating temperature may be set appropriately from the viewpoint of avoiding deformation due to self weight. When piercing is performed as hot working, the heating temperature is more preferably 1,100° C. to 1,300° C. Also, the heating method is not specifically limited and, for example, a method in which the steel is put into a heating furnace is mentioned.

Hot working is performed after the above-described heating or after cooling to a working temperature (working temperature in hot working performed thereafter), following the above-described heating.

To begin with, the detail of hot working will be described. A hot rolling process in production of the heavy-walled stainless steel seamless tube or pipe includes piercing to make the steel into a hollow base steel and elongating rolling (rolling to reduce the wall thickness and expand the tube (wall thickness reduction-tube expansion rolling) and regular rolling). A mandrel mill, an elongater, and a plug mill can be used for the wall thickness reduction-tube expansion rolling and a sizer, a leeler, and a stretch reducing mill can be used for the regular rolling. All rolling mills are used without problem.

In production of the steel tube or pipe, hot working is performed in a temperature range (hot working temperature) of 700° C. to 1,200° C. and, in addition, the hot working temperature has to be adjusted such that at least 35 area percent of austenitic phase fraction is obtained. As described above, the hot working temperature is important to adjust the phase fraction and give required strain to the ferritic phase. However, lowering of the temperature to wait austenitic phase transformation in the piercing is not favorable from the viewpoint of increase in rolling load and degradation of the hot workability. Consequently, the adjustment of the hot working temperature described below is preferably performed by wall thickness reduction-tube expansion rolling or regular rolling, and is more preferably performed by regular rolling.

Incidentally, the steel microstructure of the steel tube or pipe becomes a microstructure, in which a ferritic phase makes up the greater part, after being heated to 1,100° C. to 1,300° C., and the steel microstructure of the above-described steel after the heating primarily contains the ferritic phase. Thereafter, cooling to a hot working temperature range of 700° C. to 1,200° C. is performed and, thereby, part of ferritic phase in the steel microstructure is transformed to an austenitic phase. Subsequently, when cooling to room temperature is performed, at least part of the austenitic phase transformed from the ferritic phase becomes a ferrite-martensitic (retained austenitic phase may be included) microstructure through martensite transformation. The ferritic phase left without being transformed to the austenitic phase remains after cooling. Meanwhile, if the hot working temperature is lowered, the fraction of austenitic phase in the total phase increases and the fraction of ferritic phase in the total phase decrease relatively. Also, in ferrite-austenite duplex phase region rolling, strain can be selectively concentrated on the ferritic phase having relatively low warm strength. Most of or all the other austenitic phase undergoes martensite transformation during cooling to room temperature to become a microstructure containing many dislocations and have high strength and high toughness. Therefore, a large amount of strain is not required. That is, as described above, it is important for improving the low-temperature toughness and the yield strength to make ferrite grains fine. Therefore, it is important to give the strain in a temperature range, in which the ferritic phase fraction is reduced, and give the strain to the ferritic phase selectively to make ferrite grains fine.

As described above, the fraction of the austenitic phase in the total phase when the strain is given by hot working is important to obtain predetermined characteristics. Specifically, it is preferable that the strain be given in the temperature range in which the ferritic phase fraction is reduced. Consequently, it is preferable that the austenitic phase fraction in the hot working is examined in advance before manufacturing and the working temperature is determined on the basis of this examination result. The examination can be performed by the following method.

A small sample of a steel having a predetermined chemical composition is prepared. After heating to a furnace-equivalent temperature is performed, cooling to 1,200° C. to 700° C. corresponding to the hot working temperature is performed at a cooling rate (0.2° C./s to 1.5° C./s on a wall thickness center temperature basis) corresponding to standing to cool in manufacturing of the product. Subsequently, the microstructure is frozen by quenching and after mirror polishing, corrosion with a Villera reagent (picric acid 1 g, hydrochloric acid 5 ml, ethanol 100 ml) is performed. The ferritic phase fraction is measured, the ferritic phase fraction (%) is subtracted from the total microstructure which is assumed to be 100%, and the remaining fraction (%) is the austenitic phase fraction at hot working temperature.

As described above, to selectively give the strain to the ferritic phase and make grains fine, it is necessary that hot working be performed while the hot working temperature is lowered until at least 35 area percent of austenitic phase is obtained in the above-described manner.

In addition, after the hot working is performed, quenching, quenching and tempering, or a solution heat treatment is performed as a heat treatment in a duplex phase region of austenite and ferrite. Grain growth proceeds by holding at a high temperature of 1,150° C. or higher. However, the heat treatment is performed at lower than 1,150° C. and, therefore, control at a temperature, at which recovery of grain growth along with an increase in the ferritic phase fraction is not facilitated, can be performed in this heat treatment so that the ferrite grains which have been made fine are maintained at the stage of product and high low-temperature toughness and yield strength can be obtained.

EXAMPLES

Molten steels having the chemical compositions shown in Table 1 were prepared by a converter, cast into slabs (slab thickness: 260 mm) by a continuous casting process, and made into steels having a diameter of 230 mm by caliber rolling. The steels were put into a heating furnace and heated to 1,250° C. Thereafter, hollow base steels were produced by using a piercing apparatus. Subsequently, heavy-walled stainless steel seamless tubes or pipes were obtained by performing elongating rolling and cooling, where the hot working temperature in the regular rolling apparatus for elongating rolling was specified to be a temperature shown in Table 2. In this regard, in production, the accumulated reduction in area was specified to be 70% and the final wall thickness was specified to be 16 mm. Also, Table 2 shows the content of the austenitic phase (γ fraction) at the hot working temperature.

The resulting heavy-walled stainless steel seamless tubes or pipes were subjected to a quenching and tempering treatment at a quenching temperature (Q1) and a tempering temperature (T1) shown in Table 2.

Also, a test piece was taken from each heavy-walled stainless steel seamless tube or pipe after the heat treatment to observe the microstructures in the circumferential direction and the longitudinal direction from the wall thickness central portion of the heavy-walled stainless steel seamless tube or pipe, and the phase fraction and the ferrite grain area were measured. Also, the low-temperature toughness and the yield strength were examined by using the test piece.

(1) Microstructure Observation

A test piece for microstructure observation was taken from the thickness central portion of the resulting heavy-walled stainless steel seamless tube or pipe. A cross section orthogonal to the rolling direction (C cross section) and a cross section parallel to the rolling direction (L cross section) were subjected to electrochemical polishing and the microstructure observed with SEM and SEM-EDX (measurement range: 100×100 μm to 1,000×1,000 μm). The element partition of ferritic phase formation elements and austenitic phase formation elements was examined with SEM-EDX, and the ferritic phase fraction measured. Thereafter, the vicinity of the same portion was subjected to EBSD observation with the measurement range: 100×100 μm to 1,000×1,000 μm, and the ferrite grain area output on the basis of analysis measured, where the crystal misorientation of 15° or more in the analysis of only the ferritic phase portion extracted by observation with SEM was defined as a grain boundary. Table 3 shows the results of evaluation on the basis of the following criteria. Also, Table 3 shows the content of the ferritic phase (F fraction).

With respect to the maximum value of the areas of ferrite grains

⊙: 200 $\mu m^2$ or less

○: 1,000 $\mu m^2$ or less

Δ: 3,000 $\mu m^2$ or less x: more than 3,000 $\mu m^2$

With respect to the content of ferrite grains having a specific grain size

⊙: the content of ferrite grains having 100 $\mu m^2$ or less is 80% or more on an area fraction basis ○: the content of ferrite grains having 400 $\mu m^2$ or less is 50% or more on an area fraction basis Δ: the content of ferrite grains having 800 $\mu m^2$ or less is 50% or more on an area fraction basis x: the content of ferrite grains having 800 $\mu m^2$ or less does not satisfy 50% or more on an area fraction basis (2) Tensile Test A round-bar tensile test piece (parallel portion 6 mmϕ×GL 20 mm) was taken from the wall thickness center of the resulting heavy-walled stainless steel seamless tube or pipe such that the rolling direction agrees with the tensile direction. A tensile test was performed in conformity with the specification of JIS Z 2241 and the yield strength YS was determined. In this regard, the yield strength was the strength at the elongation of 0.2%.

(3) Impact Test

A V-notched test bar was taken from the wall thickness center of the resulting heavy-walled stainless steel seamless tube or pipe such that the direction orthogonal to the rolling direction (C direction) agrees with the test bar longitudinal direction. A Charpy impact test was performed in conformity with the specification of JIS Z 2242, the absorbed energy measured at a test temperature: −10° C., and the toughness evaluated. In this regard, the number of test bars of each tube or pipe was three, and the average value thereof was the absorbed energy of the heavy-walled stainless steel seamless tube or pipe concerned. An absorbed energy of 50 J or more was regarded as good.

TABLE 1

(unit: mass %)

| Steel | C | Si | Mn | P | S | Cr | Ni | Mo | V | Al | Cu, W, REM | Nb, Ti, Zr | Ca, B | N | O |
|---|---|---|---|---|---|---|---|---|---|---|---|---|---|---|---|
| A | 0.016 | 0.21 | 0.26 | 0.02 | 0.002 | 16.5 | 4.4 | 1.7 | 0.034 | 0.02 | Cu: 0.95<br>W: 1.00 | Nb: 0.092<br>Ti: 0.02 | Ca: 0.002<br>B: 0.001 | 0.028 | 0.0030 |
| B | 0.031 | 0.22 | 0.26 | 0.01 | 0.001 | 15.1 | 4.4 | 1.7 | 0.055 | 0.02 | Cu: 0.95<br>W: 1.01 | Nb: 0.095 | Ca: 0.001<br>B: 0.001 | 0.057 | 0.0029 |
| C | 0.014 | 0.23 | 0.26 | 0.02 | 0.001 | 17.6 | 4.3 | 2.3 | 0.046 | 0.01 | Cu: 0.94<br>W: 0.35 | Nb: 0.110 | B: 0.005 | 0.057 | 0.0030 |
| D | 0.034 | 0.22 | 0.33 | 0.02 | 0.001 | 16.6 | 3.9 | 2.4 | 0.023 | 0.01 | Cu: 1.01<br>W: 1.01 | Nb: 0.094 | Ca: 0.002 | 0.057 | 0.0029 |
| E | 0.021 | 0.23 | 0.32 | 0.02 | 0.001 | 18.8 | 0.9 | 1.0 | 0.083 | 0.02 | Cu: 0.51<br>W: 1.01 | Nb: 0.111 | — | 0.038 | 0.0030 |
| F | 0.023 | 0.22 | 0.33 | 0.02 | 0.002 | 16.9 | 3.9 | 2.2 | 0.037 | 0.01 | Cu: 0.98<br>W: 0.99 | Nb: 0.113<br>Ti: 0.01 | B: 0.002 | 0.057 | 0.0030 |
| G | 0.021 | 0.31 | 0.25 | 0.01 | 0.001 | 17.6 | 4.1 | 2.3 | 0.037 | 0.02 | Cu: 0.35<br>W: 0.36 | Nb: 0.145<br>Ti: 0.01 | Ca: 0.002 | 0.101 | 0.0029 |
| H | 0.046 | 0.26 | 0.33 | 0.01 | 0.001 | 16.3 | 3.6 | 2.6 | 0.035 | 0.01 | Cu: 0.35<br>W: 0.34<br>REM: 0.001 | Nb: 0.095<br>Zr: 0.014 | — | 0.037 | 0.0029 |
| I | 0.045 | 0.25 | 0.25 | 0.01 | 0.001 | 16.5 | 3.9 | 2.8 | — | 0.001 | — | — | — | 0.065 | 0.0030 |

* Underlined data are out of the scope of the present invention.

TABLE 2

| | Steel | Hot working temperature ° C. | γ fraction % | Q1 ° C. | T1 ° C. | Sample |
|---|---|---|---|---|---|---|
| Invention | A | 1000 | 76 | 930 | 620 | 1 |
| Invention | A | 1180 | 43 | 930 | 620 | 2 |
| Invention | A | 900 | 79 | 930 | 620 | 3 |
| Invention | A | 700 | 81 | 930 | 620 | 4 |
| Comparison | A | 1250 | 33 | 930 | 620 | 5 |
| Comparison | B | 1000 | 100 | 930 | 620 | 6 |
| Comparison | B | 1200 | 75 | 930 | 620 | 7 |
| Invention | C | 1000 | 69 | 930 | 620 | 8 |
| Invention | C | 900 | 70 | 930 | 620 | 9 |
| Invention | C | 1150 | 47 | 930 | 620 | 10 |
| Comparison | C | 1250 | 22 | 930 | 620 | 11 |
| Invention | C | 700 | 71 | 930 | 620 | 12 |
| Invention | D | 1000 | 64 | 930 | 620 | 13 |
| Invention | D | 900 | 71 | 930 | 620 | 14 |
| Comparison | D | 1210 | 30 | 930 | 620 | 15 |
| Invention | D | 700 | 74 | 930 | 620 | 16 |
| Comparison | E | 1000 | 8 | 930 | 620 | 17 |
| Comparison | E | 1210 | 0 | 930 | 620 | 18 |

TABLE 2-continued

| | Steel | Hot working temperature ° C. | γ fraction % | Q1 ° C. | T1 ° C. | Sample |
|---|---|---|---|---|---|---|
| Comparison | E | 900 | 5 | 930 | 620 | 19 |
| Invention | F | 1000 | 70 | 930 | 620 | 20 |
| Invention | F | 1150 | 46 | 930 | 620 | 21 |
| Invention | F | 900 | 80 | 930 | 620 | 22 |
| Comparison | F | 1210 | 32 | 930 | 620 | 23 |
| Invention | F | 800 | 78 | 930 | 620 | 24 |
| Invention | G | 1000 | 71 | 930 | 620 | 25 |
| Invention | G | 1150 | 47 | 930 | 620 | 26 |
| Invention | G | 900 | 71 | 930 | 620 | 27 |
| Comparison | G | 1230 | 31 | 930 | 620 | 28 |
| Invention | H | 1000 | 66 | 930 | 620 | 29 |
| Invention | H | 1150 | 46 | 930 | 620 | 30 |
| Invention | H | 900 | 67 | 930 | 620 | 31 |
| Comparison | H | 1210 | 33 | 930 | 620 | 32 |
| Invention | I | 1000 | 74 | 930 | 620 | 33 |
| Invention | I | 1150 | 55 | 930 | 620 | 34 |
| Invention | I | 900 | 95 | 930 | 620 | 35 |
| Comparison | I | 1250 | 32 | 930 | 620 | 36 |

* Underlined data are out of the range of the production condition of the present invention.
* "Invention" refers to invention example, and "Comparison" refers to comparative example.

J or more at a test temperature: −10° C. in spite of high strength of yield strength: 654 MPa or more. On the other hand, the heavy-walled stainless steel seamless tube or pipe having the microstructure out of our range (here, referred to as comparative example) does not satisfy at least one of the maximum value of ferrite grain areas of 3,000 $\mu m^2$ or less and the content of ferrite grains having areas of 800 $\mu m^2$ or less of 50% or more on an area fraction basis and, therefore, the predetermined strength and toughness are not able to be ensured. Also, those having the chemical composition out of our range are not able to ensure the corrosion resistance (although there is no date of the corrosion resistance in the table, Sample Nos. 6 and 7 having a Cr content out of our range exhibit poor corrosion resistance), the strength, or the toughness.

The invention claimed is:

1. A high-strength heavy-walled stainless steel seamless tube or pipe with excellent low-temperature toughness, comprising a steel microstructure containing a ferritic phase and a martensitic phase, and a chemical composition consisting of, on a percent by mass basis, Cr: 15.5% to 18.0%, C: 0.050% or less, Si: 1.00% or less, Mn: 0.20% to 1.80%, Ni: 1.5% to 5.0%, Mo: 1.0% to 3.5%, V: 0.02% to 0.20%, N: 0.02% to 0.15%, O: 0.006% or less, W: 0.5% to 3.5%,

TABLE 3

| | Sample | YS MPa | $vE_{-10}$ J | F fraction % | Maximum value of ferrite grain areas (L and C cross-sections) | Content of ferrite grains having a specific grain size (L and C cross-sections) |
|---|---|---|---|---|---|---|
| Invention | 1 | 777 | 68 | 25 | ○ | Δ |
| Invention | 2 | 773 | 57 | 26 | Δ | Δ |
| Invention | 3 | 788 | 85 | 24 | ⊙ | ⊙ |
| Invention | 4 | 785 | 82 | 25 | ⊙ | ○ |
| Comparison | 5 | 770 | 43 | 26 | X | X |
| Comparison | 6 | 865 | 83 | 4 | ⊙ | ⊙ |
| Comparison | 7 | 863 | 79 | 5 | ⊙ | ⊙ |
| Invention | 8 | 770 | 70 | 28 | ○ | Δ |
| Invention | 9 | 773 | 79 | 28 | ⊙ | ⊙ |
| Invention | 10 | 763 | 56 | 28 | Δ | Δ |
| Comparison | 11 | 760 | 32 | 30 | X | X |
| Invention | 12 | 770 | 78 | 28 | ⊙ | ○ |
| Invention | 13 | 762 | 63 | 31 | ○ | Δ |
| Invention | 14 | 769 | 80 | 30 | ⊙ | ⊙ |
| Comparison | 15 | 758 | 34 | 32 | X | X |
| Invention | 16 | 768 | 77 | 32 | ⊙ | ○ |
| Comparison | 17 | 492 | 11 | 95 | X | X |
| Comparison | 18 | 488 | 9 | 94 | X | X |
| Comparison | 19 | 493 | 21 | 95 | X | X |
| Invention | 20 | 783 | 66 | 23 | ○ | Δ |
| Invention | 21 | 779 | 55 | 24 | Δ | Δ |
| Invention | 22 | 789 | 76 | 23 | ⊙ | ⊙ |
| Comparison | 23 | 776 | 35 | 23 | X | X |
| Invention | 24 | 790 | 78 | 23 | ⊙ | ⊙ |
| Invention | 25 | 791 | 63 | 22 | ○ | Δ |
| Invention | 26 | 788 | 52 | 23 | Δ | Δ |
| Invention | 27 | 793 | 71 | 22 | ⊙ | ⊙ |
| Comparison | 28 | 786 | 23 | 22 | X | X |
| Invention | 29 | 775 | 65 | 25 | ○ | Δ |
| Invention | 30 | 771 | 55 | 26 | Δ | Δ |
| Invention | 31 | 780 | 73 | 25 | ⊙ | ⊙ |
| Comparison | 32 | 767 | 42 | 26 | X | X |
| Invention | 33 | 785 | 68 | 21 | ○ | Δ |
| Invention | 34 | 782 | 65 | 22 | ○ | Δ |
| Invention | 35 | 792 | 76 | 21 | ⊙ | ⊙ |
| Comparison | 36 | 777 | 33 | 21 | X | X |

* Underlined results are not good.
* "Invention" refers to invention example, and "Comparison" refers to comparative example.

As for every heavy-walled stainless steel seamless tube or pipe having our microstructure (here, referred to as present example), the ferritic phase is able to be made fine even at the wall thickness center position, and the toughness is improved considerably such that the absorbed energy is 50 optionally, at least one group selected from Group A to Group D:

Group A: Al: 0.002% to 0.050%,

Group B: at least one selected from Cu: 3.5% or less, W: 3.5% or less, and REM: 0.3% or less, Group C: at least one selected from Nb: 0.2% or less, Ti: 0.3% or less, and Zr: 0.2% or less, Group D: at least one selected from Ca: 0.01% or less and B: 0.01% or less, and the remainder composed of Fe and incidental impurities, wherein ferrite grains have maximum areas of 3,000 $\mu m^2$ or less in the steel microstructures in a circumferential direction cross section and an L direction (rolling direction) cross section of the steel tube or pipe and content of ferrite grains having areas of 800 $\mu m^2$ or less is 50% or more on an area fraction basis, where, adjacent grains are grains different from each other when crystal mis-orientation between one ferrite grain and another ferrite grain is 15° or more.

2. A method of manufacturing a high-strength heavy-walled stainless steel seamless tube or pipe according to claim 1, comprising: heating a steel, performing piercing the steel to produce a hollow base steel, and subjecting the hollow base steel to elongating rolling, wherein the elongating rolling includes adjusting a hot working temperature of 700° C. to 1,200° C. and obtaining a steel microstructure of the hollow base steel at the hot working temperature that contains 35% or more of austenite on an area fraction basis.

3. The high-strength heavy-walled stainless steel seamless tube or pipe according to claim 1, wherein the chemical composition contains C: 0.030% to 0.050%.

4. A method of manufacturing a high-strength heavy-walled stainless steel seamless tube or pipe according to claim 3, comprising: heating a steel, performing piercing the steel to produce a hollow base steel, and subjecting the hollow base steel to elongating rolling, wherein the elongating rolling includes adjusting a hot working temperature of 700° C. to 1,200° C. and obtaining a steel microstructure of the hollow base steel at the hot working temperature that contains 35% or more of austenite on an area fraction basis.

* * * * *